US008468658B1

(12) United States Patent
Rife

(10) Patent No.: US 8,468,658 B1
(45) Date of Patent: Jun. 25, 2013

(54) ADJUSTABLE BELT ASSEMBLY

(76) Inventor: Kimiko Chapman Rife, Austin, TX (US)

( * ) Notice: Subject to any disclaimer, the term of this patent is extended or adjusted under 35 U.S.C. 154(b) by 954 days.

(21) Appl. No.: 12/510,710

(22) Filed: Jul. 28, 2009

Related U.S. Application Data

(60) Provisional application No. 61/083,980, filed on Jul. 28, 2008.

(51) Int. Cl.
*A44B 18/00* (2006.01)

(52) U.S. Cl.
USPC ..... 24/306; 24/182; 24/197; 24/265 BC; 24/265 AL

(58) Field of Classification Search
USPC ..... 24/305–310, 163 R, 182, 193, 197, 24/200, 265 BC, 265 AL; 2/311, 321, 322, 2/338
See application file for complete search history.

(56) References Cited

U.S. PATENT DOCUMENTS

| | | | | | |
|---|---|---|---|---|---|
| 4,149,540 | A * | 4/1979 | Hasslinger | 606/203 |
| 4,413,389 | A * | 11/1983 | Lowe | 24/312 |
| 4,999,853 | A * | 3/1991 | Tanner | 2/321 |
| 5,237,988 | A * | 8/1993 | McNeese | 128/207.17 |
| 5,413,262 | A * | 5/1995 | Dewire et al. | 224/675 |
| 5,548,871 | A * | 8/1996 | Trethewey | 24/16 R |
| 5,769,290 | A * | 6/1998 | Pestana | 224/178 |
| 5,806,087 | A * | 9/1998 | Grotefend | 2/1 |
| 5,867,839 | A * | 2/1999 | Lawlor | 2/240 |
| 6,081,925 | A * | 7/2000 | Reiber | 2/125 |
| 6,131,249 | A * | 10/2000 | Suenaga | 24/306 |
| 6,138,882 | A * | 10/2000 | Buettner | 224/250 |
| 6,449,815 | B1 * | 9/2002 | Spiller | 24/306 |
| 6,553,944 | B1 * | 4/2003 | Allen et al. | 119/769 |
| 7,039,958 | B2 * | 5/2006 | Henricksen | 2/338 |
| 7,065,842 | B2 * | 6/2006 | Haglof | 24/306 |
| 7,219,405 | B1 * | 5/2007 | Nevens | 24/464 |
| 7,752,722 | B2 * | 7/2010 | Calkin | 24/632 |
| 8,069,540 | B2 * | 12/2011 | Obiols et al. | 24/306 |
| 8,214,975 | B2 * | 7/2012 | Calkin | 24/632 |
| 2002/0092138 | A1 * | 7/2002 | Spiller | 24/306 |
| 2005/0125965 | A1 * | 6/2005 | Joosten et al. | 24/306 |
| 2008/0148533 | A1 * | 6/2008 | Calkin | 24/302 |
| 2008/0201915 | A1 * | 8/2008 | Obiols et al. | 24/306 |

* cited by examiner

*Primary Examiner* — Robert J Sandy
*Assistant Examiner* — Tyler Johnson
(74) *Attorney, Agent, or Firm* — Law Offices of Mark L. Berrier

(57) ABSTRACT

An adjustable belt and buckle mechanism typically used with clothing, but not exclusive to this use. In one embodiment, the belt assembly has a unique design using hook-and-loop fasteners, as well as metal hook and eye fasteners, in combination with a double-loop buckle that joins the two ends of the belting via the buckle for an adjustable and easily closable belting, cinching, or tie down product.

11 Claims, 1 Drawing Sheet

ADJUSTABLE BELT ASSEMBLY

CROSS-REFERENCE TO RELATED APPLICATIONS

This application claims the benefit of U.S. Provisional Patent Application 61/083,980, filed Jul. 28, 2008, which is incorporated by reference as if set forth herein in its entirety.

BACKGROUND

The invention relates to belt assemblies, and more particularly to an adjustable belt and buckle mechanism having a connector that can be adjustably positioned along the length of the belt to allow the size of the belt to be easily adjusted, then fastened.

SUMMARY OF THE INVENTION

The present invention includes adjustable belt and buckle assemblies having a connector that can be adjustably positioned along the length of the belt to allow the size of the belt to be easily adjusted, then fastened. In one embodiment, an adjustable belt assembly includes an elongated strip of belting material, a buckle and an adjustment ring. The buckle is coupled to a first end of the strip of belting material. The buckle has a first loop sized to allow a second end of the strip of belting material to pass therethrough. The adjustment ring is positioned around the strip of belting material, and is movably attached to the strip of belting material at an adjustable position. A fastener such as a hook-and-loop closure is used to attach the adjustment ring to the strip of belting material. When the second end of the belting material is passed through the first loop of the buckle, the fastener secures the second end of the strip of belting material to the adjustment ring, thereby securing the adjustable belt assembly at a size that is determined by the position of the adjustment ring along the length of the strip of belting material.

Numerous embodiments are possible.

BRIEF DESCRIPTION OF THE DRAWINGS

Other objects and advantages of the invention may become apparent upon reading the following detailed description and upon reference to the accompanying drawings.

Figure 1:
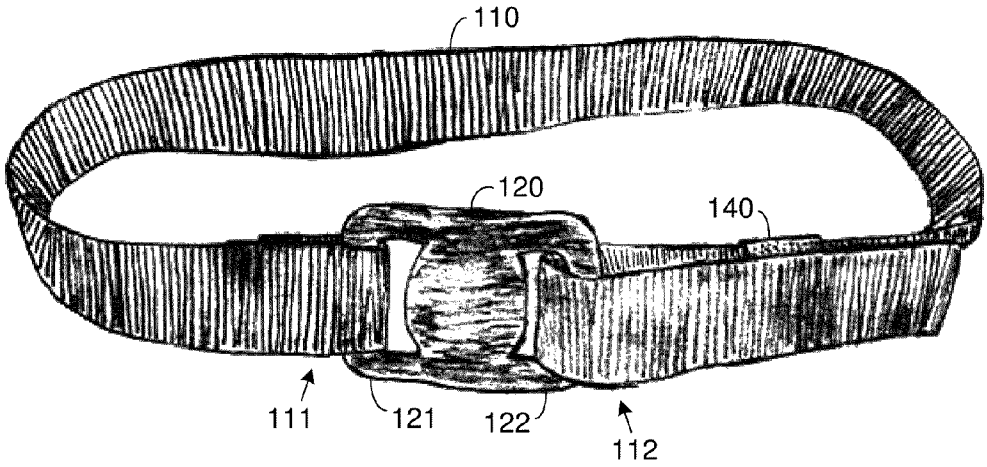
FIGS. 1 and 2 are diagrams illustrating an adjustable belt in accordance with one embodiment.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims.

DETAILED DESCRIPTION OF EXEMPLARY EMBODIMENTS

One or more embodiments of the invention are described below. It should be noted that these and any other embodiments described below are exemplary and are intended to be illustrative of the invention rather than limiting.

It will be helpful to first define some of the terms that are used in the present disclosure.

V-Hook and V-Eye. An exemplary embodiment of the invention uses hook-and-loop closure material (often simply referred to by the trade name "Velcro") as a fastening mechanism. One of the components of the material is a Velcro-like hook material and the other is a Velcro-like eye material. For the purpose of this description the terms used for this mechanism shall be V-Hook and V-Eye respectively. It will be understood by those of skill in the art of the invention that alternative embodiments may switch the V-Hook and V-Eye materials from the description herein, or they may use entirely different fastening mechanisms. Such changes are understood to be within the scope of the present disclosure.

Adjustment Ring. The present belting assembly uses an adjustment ring as part of the closure mechanism in order to easily modify the size (circumference) of the belt assembly. The adjustment ring is connected to the belt at a position that is adjustable—the end of the belt is fastened by connecting it to the adjustment ring. For the purposes of this description, an exemplary belt assembly uses V-Hook material to connect the ring to a closure strip (described below). In this embodiment, the ring is produced using material sewn into a ring with a piece of V-Hook sewn onto the ring. Other hook type materials or devices could also be applicable for this functionality.

Double-Loop Buckle. The double-loop buckle has two loops, one on each end of the buckle. The loops will be referred to herein as an adjustment opening and a fixed opening. The double-loop buckle serves the similar purpose as other belt buckles, whereby it secures the two ends of the belting to form a loop. The positioning of the adjustment ring allows the end of the belt positioned through the adjustment opening in a manner that facilitates closure of the belting to an adjustable, desired fit.

Closure Strip. The closure strip is a strip of hook-and-loop material positioned at the end of the belt and used to connect the end of the belt to the adjustment ring, thereby fastening the belt. In the exemplary embodiment, the closure strip is formed by V-Eye material positioned at one end of the belting material. Other types of connectors can be used in alternative embodiments to fasten the end of the belt to the adjustment ring.

Adjustment strip. The adjustment strip is a means for attaching the adjustment ring to the belting material. The adjustment ring can be moved along the adjustment strip and affixed to a location along the length of the adjustment strip. The adjustment strip in this embodiment is a strip of V-Eye material attached to the interior (body-side) of the belting but, similar to the closure strip, can be any material or device that provides a means to adjustably affix the adjustment ring to the belting.

Figure 2:
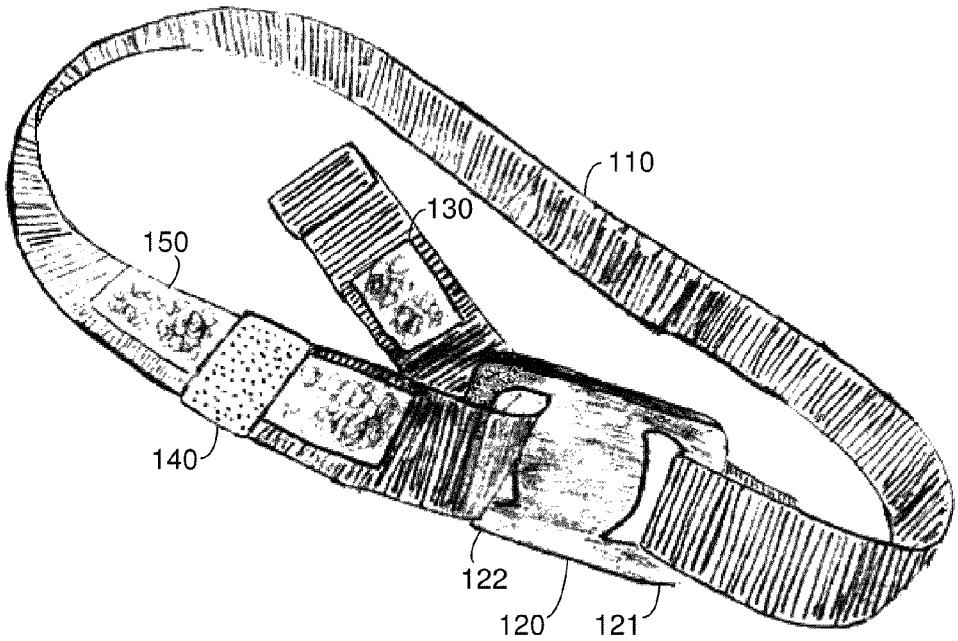

The belting is now described with respect to the diagrams of FIGS. 1 and 2. FIGS. 1 and 2 are diagrams illustrating an adjustable belt in accordance with one embodiment, where FIG. 1 shows the belt in a fastened position, and FIG. 2 shows the belt in an unfastened position. FIG. 2 shows the hook-and-loop closure materials that form the adjustment ring, adjustment strip and closure strip.

The adjustable belt includes a strip of belting material 110, such as fabric webbing, although many other materials may also be suitable. The belting has a different fastening mechanism on each end. The ends are called the adjustable closure end 112 and the fixed closure end 111. The adjustable closure end of the belting pulls through one loop (122) of the double-loop buckle 120 and then the closure strip 130 attaches and locks to the adjustment ring 140.

The fixed closure end 111 of the belting closes around the other loop (121) of the double-loop buckle 120. For example, in one embodiment, it may be fastened with a metal hook and eye. This hook and eye is attached to the belting end in such a placement that the tension from the belt, once the adjustable closure end is secured, maintains the closure of the fixed closure end of the belting material to the double-loop buckle. The fixed closure end of the belting closes around the double-loop buckle to provide a closed end that does not easily open. The fixed closure end of the belting can be a secured, yet detachable end as described above, or it may be permanently attached.

The fixed closure end of the belting feeds through a loop of the double-loop buckle and locks while the adjustable closure end of the belting feeds through the other loop of the double-loop buckle. The adjustable closure end of the belting closes and locks to the desired tension or fit.

The adjustment ring 140 encircles the belting 110 and can slide along the belting for affixing at any position along the adjustment strip 150. The adjustment ring 140 has two attachment points. At one attachment point, the adjustment ring 140 is affixed to the interior (body-side) of the belting along the adjustment strip 150 at a desired location to provide the desired fit or tension. At the other attachment point, the adjustment ring 140 is affixed to the closure strip 130.

The embodiments of the present invention may provide a number of advantages over prior art belts. For instance, the belt may provide customizable adjustment to a specific fit. As noted above, one end of the belting uses a ring called an adjustability ring. This end is referred to as the adjustable closure end. The adjustability ring attaches to the interior of the belting along the adjustment strip. The ring slides along and affixes to the adjustment strip at a desired location, providing a mechanism to adjust the belting length to specific desired length.

The belt may also be continuously adjustable as needed for a desired fit. The belting may be replaceable with longer or shorter length belting by use of a fastening mechanism on the non-adjustment end of the belting. The non-adjustment end can be constructed using a hook-and-eye attached to the belting such that the pulling tension around the body maintains tension for closure against the hook and eye.

The buckle design can support belt interchangeability, which supports belt adjustability. The buckle may be a roughly rectangular shape with loop openings on the left and right ends to form a double-loop buckle. The design of the double-loop buckle supports the connection of the adjustment end of the belting to the buckle, as well as the non-adjustment end of the belting to the buckle. One design of the belting allows both ends to be detached from the double-loop buckle, thus providing interchangeability between belts and buckles.

The adjustment ring on the belting supports ease of closure. The adjustment ring is positioned and affixed in a location along the adjustment strip for the desired fit, which allows easy repeated closure for the desired belting fit. The belt closes by use of hook-and-loop material where, for example, the adjustment ring can provide the hooks of the closure and the loop portion can be provided by the adjustment closure strip. The adjustment strip is affixed to the interior (body-side) of the belting. This end of the belting is called the adjustable closure end.

The closure strip of the belting supports ease of closure. The adjustment ring can be placed at the desired location along the adjustment strip, which then provides ease of closure via the closure strip. The closure strip can, for example, provide the loop portion of the hook-and-loop fastening mechanism.

The double-loop buckle supports the ease of closure. The adjustable end of the belting pulls through a loop opening of the double-loop buckle. This aspect of the buckle provides a lever-like pulling action, which can be performed with a single hand to provide ease of closure to persons of limited dexterity.

The belt can provide ease of repeated closure tension. The placement of the adjustment ring working with the closure strip is determined once, at which time the adjustment ring is locked/hooked to the adjustment strip. This allows repeated closure, giving the same determined fit without searching for the desired tension location.

The belt can have multiple possible design uses. For instance, the means of adjustment and ease of closure lends itself to uses such as adjustable belts for children and persons of limited dexterity. Further, the belts can serve as adjustable tie downs for camping and hiking equipment, boating equipment, aircraft or spacecraft equipment, backpacks, and the like. The Tie Downs could be used in locations where rusting of a metal tie down might be of concern and undesirable. The belts can also serve as adjustable low- to medium-tension cinches.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the following claims.

What is claimed is:

1. An adjustable belt assembly comprising:

an elongated strip of belting material;

a buckle coupled to a first end of the strip of belting material, wherein the buckle has a first aperture therethrough, wherein the first aperture is sized to allow a second end of the strip of belting material to pass therethrough;

an adjustment ring positioned around the strip of belting material, wherein the adjustment ring has hook-and-loop material on both inner and outer sides so that the adjustment ring is detachably engageable on the inner side of the adjustment ring with an adjustment strip made of hook-and-loop material and located on the strip of belting material, thereby enabling the adjustment ring to be coupled to and uncoupled from the strip of belting material at an adjustable position along the length of the strip of belting material, wherein the adjustment ring is further detachably engageable on the outer side of the adjustment ring with a closure strip made of hook-and-loop material and connected to the second end of the strip of belting material, thereby enabling the closure strip to be coupled to and uncoupled from the adjustment ring; and wherein the adjustment strip and the closure strip are positioned on opposing sides of the strip of belting material; and wherein when the second end of the strip of belting material is passed through the first aperture of the buckle, the closure strip is engaged with the adjustment ring, thereby securing the second end of the strip of belting material to the adjustment ring and securing the adjustable belt assembly on a user at a size that is determined by the position of the adjustment ring along the length of the strip of belting material; and wherein when the closure strip is disengaged from the adjustment ring, the second end of the belting material is removable from the first aperture of the buckle, enabling the belt assembly to be removed from the user.

2. The adjustable belt assembly of claim 1, wherein the belting material comprises fabric webbing.

3. The adjustable belt assembly of claim 1, wherein the buckle comprises a single rigid piece having the first aperture at a first end thereof and a second aperture at a second end thereof, wherein the first end of the belting material is positioned through the second aperture and secured to the belting material to form a loop that secures the buckle to the belting material.

4. The adjustable belt assembly of claim 1, wherein the adjustment ring is positioned at one of a plurality of predetermined positions along the length of the strip of belting material.

5. The adjustable belt assembly of claim 1, wherein the buckle is detachably coupled to the first end of the strip of belting material.

6. An improvement to a belt which is worn around a person's waist, wherein the belt includes an elongated strip of belting material having a buckle coupled to a first end of the strip of belting material, and wherein the buckle has a first loop which is sized to allow a second end of the strip of belting material to pass therethrough, the improvement comprising:

an adjustment ring positioned around the strip of belting material, wherein the adjustment ring has hook-and-loop material on both inner and outer sides so that the adjustment ring is detachably engageable on the inner side of the adjustment ring with an adjustment strip made of hook-and-loop material and located on the strip of belting material, thereby enabling the adjustment ring to be coupled to and uncoupled from the strip of belting material at an adjustable position along the length of the strip of belting material, wherein the adjustment ring is further detachably engageable on the outer side of the adjustment ring with a closure strip made of hook-and-loop material and connected to the second end of the strip of belting material, thereby enabling the closure strip to be coupled to and uncoupled from the adjustment ring; and wherein the adjustment strip and the closure strip are positioned on opposing sides of the strip of belting material; and wherein when the second end of the strip of belting material is passed through the first aperture of the buckle, the closure strip is engaged with the adjustment ring, thereby securing the second end of the strip of belting material to the adjustment ring and securing the belt on a user at a size that is determined by the position of the adjustment ring along the length of the strip of belting material; and wherein when the closure strip is disengaged from the adjustment ring, the second end of the belting material is removable from the first aperture of the buckle, enabling the belt to be removed from the user.

7. The improvement of claim 6, wherein the belting material comprises fabric webbing.

8. The improvement of claim 6, wherein the buckle comprises a single rigid piece having the first aperture at a first end thereof and a second aperture at a second end thereof, wherein the first end of the belting material is positioned through the second aperture and secured to the belting material to form a loop that secures the buckle to the belting material.

9. The improvement of claim 6, wherein the adjustment ring is positioned at one of a plurality of predetermined positions along the length of the strip of belting material.

10. The improvement of claim 6, wherein the buckle is detachably coupled to the first end of the strip of belting material.

11. An adjustable belt assembly comprising:

an elongated strip of fabric webbing belting material;

a double-loop buckle having a first end of the strip of belting material secured through a first loop of the buckle, wherein a second loop of the buckle is sized to allow a second end of the strip of belting material to pass therethrough;

an adjustment ring positioned around the strip of belting material, wherein the adjustment ring has hook-and-loop material on both inner and outer sides so that the adjustment ring is detachably engageable on the inner side of the adjustment ring with an adjustment strip made of hook-and-loop material and located on the strip of belting material, thereby enabling the adjustment ring to be coupled to and uncoupled from the strip of belting material at an adjustable position along the length of the strip of belting material, wherein the adjustment ring is further detachably engageable on the outer side of the adjustment ring with a closure strip made of hook-and-loop material and connected to the second end of the strip of belting material, thereby enabling the closure strip to be coupled to and uncoupled from the adjustment ring; and wherein the adjustment strip and the closure strip are positioned on opposing sides of the strip of belting material; and wherein when the second end of the strip of belting material is passed through the second loop of the buckle, the closure strip is engaged with the adjustment ring, thereby securing the second end of the strip of belting material to the adjustment ring, thereby securing the adjustable belt assembly around a person's waist at a size that is determined by the position of the adjustment ring along the length of the strip of belting material; and wherein when the closure strip is disengaged from the adjustment ring, the second end of the strip of belting material is removable from the second loop of the buckle, thereby enabling the adjustable belt assembly to be removed from the person's waist.

* * * * *